United States Patent [19]

Hasegawa et al.

[11] 4,141,849

[45] Feb. 27, 1979

[54] DEVELOPER FOR DEVELOPING ELECTROSTATIC LATENT IMAGES

[75] Inventors: Tetsuo Hasegawa, Tokyo; Hitoshi Touma, Kawasaki; Kunio Satomi, Yokohama; Tatsuo Miyamae, Toride, all of Japan

[73] Assignee: Canon Kabushiki Kaisha, Tokyo, Japan

[21] Appl. No.: 770,526

[22] Filed: Feb. 22, 1977

[51] Int. Cl.[2] ..... G03G 9/08

[52] U.S. Cl. ..... 252/62.1 P; 96/15 D; 260/664; 260/653.9

[58] Field of Search ..... 252/62.1 R, 62.1 P, 252/62.1 L; 260/664, 653.9

[56] References Cited

U.S. PATENT DOCUMENTS

| | | | |
|---|---|---|---|
| 2,993,567 | 7/1961 | Schnachner | 260/653.9 |
| 3,798,167 | 3/1974 | Kukla et al. | 252/62.1 P |
| 3,983,045 | 9/1976 | Jugle et al. | 252/62.1 P |
| 4,051,077 | 9/1977 | Fisher | 252/62.1 P |

FOREIGN PATENT DOCUMENTS

| | | | |
|---|---|---|---|
| 1101536 | 8/1976 | Japan | 252/62.1 P |

OTHER PUBLICATIONS

Watanabe et al., "Reaction of Fluorine and Carbon and Properties of their Compounds", Chem. Abstract, vol. 75, p. 584, No. 44415s (1971).

*Primary Examiner*—John D. Welsh

*Attorney, Agent, or Firm*—Fitzpatrick, Cella, Harper & Scinto

[57] ABSTRACT

Graphite fluoride is added to a developer for developing electrostatic latent images.

14 Claims, No Drawings

DEVELOPER FOR DEVELOPING ELECTROSTATIC LATENT IMAGES

BACKGROUND OF THE INVENTION

1. Field of the Invention

The present invention relates to a developer for developing electrostatic latent images, and in particular, to a developer for developing electrostatic latent images used in electrophotography, electrostatic printing or the like. The developer includes so-called "toner". Further, the toner may be used together with a carrier such as solid particles, for example, iron powder, and glass beads, and insulating liquids.

The present invention more particularly relates to a developer for color electrophotography where a plurality of color toners including magenta, cyan and yellow toners or for electrophotographic printing process where letters, patterns and the like are printed on cloths by using electrophotography. 2. Description of the Prior Art There are known photographic methods or printing methods comprising forming electrostatic latent images on a surface of an image forming member such as a photosensitive member composed of a photoconductive material, and visualizing the electrostatic latent images with toner. For example, such electrophotographic methods are disclosed in U.S. Pat. No. 2,297,691, Japanese Patent Publication Nos. Sho 42-23910, Sho 43-24748 and the like. These methods usually comprise using a photoconductive material as a photosensitive material, charging, exposing, other procedures to produce electrostatic latent images on the photosensitive material, if desired, transferring the resulting toner images onto a receiving member, or transferring the electrostatic latent images to a receiving member followed by developing with toner, and then fixing with heat, pressure or a solvent vapor, to obtain a copy. As a method for visualizing electrostatic latent images with toner, there are known various methods, for example, a magnetic brush method as disclosed in U.S. Pat. No. 2,874,063, a cascade method as in U.S. Pat. No. 2,618,552 and a powder cloud method as in U.S. Pat. No. 2,221,776. As toners used in these developing methods, there are known fine powders composed of dye or pigment dispersed in a binder, and toners containing various additives as disclosed in Japanese Patent Publication Nos. Sho 38-11096, Sho 40-10866, and Sho 44-6398.

The above mentioned developing methods are called "dry developing process". In the dry developing process there may be used iron powder, glass beads as a carrier together with a toner, or there may be not used any carrier. Further, there are known wet developing methods, where a toner is dispersed in a highly insulating solvent such as Isopar H (trade name).

Further there is known a color electrophotographic process where color reproduction of a color original is conducted by electrophotography. This process is carried out by exposing a panchromatic photosensitive member subsequently through color separation filters of blue, green and red to produce the corresponding electrostatic images, developing with yellow, magenta, and cyan toners subsequently, overlying the developed images or transferring the developed images subsequently to a receiving sheet, and then fixing to produce a colored copy. Further, if desired, a black toner is used for emphasizing image shadow portions.

In a color electrophotographic process containing the above mentioned color image forming steps it is not easy to obtain stable images constantly owing to change of charging properties of each color toner with the lapse of time. In addition, in color electrophotographic processes it is sometimes necessary to change optionally the degree of color mixing in accordance with user's taste. Therefore, color electrophotography is subjected to various limitations as to the developer, in particular, composition of toner as compared with monochromic electrophotography. There have been recently developed electrophotographic printing process for printing patterns on cloth or textile. Such electrophotographic printing process may be effected by forming electrostatic latent images corresponding to desired patterns and letters, developing the latent images with a toner for electrophotographic printing, transferring the developed images to cloths, steaming, soaping and drying. The formation of the electrostatic latent images may be conducted by one of various electrophotographic processes such as Carlson process as disclosed in U.S. Pat. No. 2,297,691, Electrofax process described in C. J. Young, H. G. Greig et al.: RCA Rev. 15, 469 (1954), Canon NP process as disclosed in U.S. Pat. Nos. 3,666,363 and 3,438,706.

The printing toner used for the electrophotographic printing process is required to dye chemically various cloths, give sharp patterns, and have wash resistance, heat resistance when ironed, and sun light resistance. Therefore, conventional electrophotographic toners to be transferred to papers and attached physically or electrically can not be simply used for the electrophotographic printing on cloths.

According to electrophotographic printing processes, after transferring printing toners, the toners are subjected to steaming, soaping, and drying so as to dye cloths with a dyestuff contained in the toner, and if necessary, a resin constituting a toner is removed. Therefore, the toner for electrophotographic printing processes is different from toners to be transferred to or fixed to papers with respect to the composition.

As printing toners, there are usually used natural or synthetic vehicle resin and a water soluble dye. The dye varies depending upon the type of cloth material. For example, a disperse dye is used for polyester fiber, a cation dye for acrylic fiber, an acid dye for polyamide fiber and wool, and reactive dye, direct cotton dye, sulfur dye for cellose and silk fiber.

As mentioned above, the dye used for printing toners varies depending upon type of cloth and color. Consequently it is difficult to control chargeability of printing toner using various dyes. In addition, many colors should be prepared to meet user's taste. This can be done by preparing some elemental color toners and mixing them accordingly to obtain desired color. However, it is difficult to uniformly control the chargeability of such mixed toner.

SUMMARY OF THE INVENTION

According to the present invention, there is provided a developer for developing electrostatic latent images which comprises toner particles and finely divided graphite fluoride.

According to another aspect of the present invention, there is provided a toner for developing electrostatic latent images which comprises a colorant selected from dye and pigment and graphite fluoride in a resin.

An object of the present invention is to provide a developer for developing electrostatic latent images where the toner shows a uniform and sufficient chargeability regardless of the type of coloring material such as dye and pigment.

Another object of the present invention is to provide a dry or wet type developer for developing electrostatic latent images where chargeability of toner is stable and practically sufficient.

A further object of the present invention is to provide a dry or wet type developer for developing electrostatic latent images where a toner is stable and shows a sufficient chargeability regardless of color density and hue.

Still another object of the present invention is to provide a dry or wet type developer for developing electrostatic latent images which does not cause fusing of the toner to an electrophotographic photosensitive member.

A still further object of the present invention is to provide a dry or wet type developer for color electrophotography where chargeability is sufficient and stable regardless of amount and type of the coloring material.

Still another object of the present invention is to provide a dry or wet type developer suitable for electrostatic printing processes.

DESCRIPTION OF THE PREFERRED EMBODIMENTS

The graphite fluoride used in the present invention is an inorganic compound of carbon and fluorine and, in particular, a layer-like compound of a graphite type which may be represented by the formula $$(CF_x)_n$$

where n is a number larger than zero and $0<x\leqq 1$. Such graphite fluoride is known and has been used as an abrasive or lubricant. According to the present invention, the graphite fluoride is used as an additive to a developer for developing electrostatic latent images.

When the degree of fluorination is 100%, i.e. $x = 1$ in the above formula, the graphite fluoride is white and called polycarbon monofluoride.

As a starting carbon for producing the graphite fluoride used in the present invention, there may be mentioned petroleum coke, coal coke, natural graphite, artificial graphite, charcoal, carbon black, carbon for binder and a mixture thereof, and the carbon is treated so as to produce a covalent bond with fluorine. The process for the preparation of the graphite fluoride is disclosed in "Cermatic", 4 (4) 301, 1969; Denki Kagaku, 51, 756–761, 1963; Denki Kagaku 35, 19–23, 1967 and others.

The degree of fluorination is not necessarily restricted to 100%, but in a graphite fluoride of the above formula the value of x is preferably at least about 0.5.

The graphite fluoride in the present invention shows a stable and sufficient charge control (particularly, negative charge control) effect in developers for developing electrostatic latent images. Further, since the graphite fluoride is white or of light color, density of color toner can be freely and easily effected regardless of chargeability of the color toner. When plural kinds of developers are used, for example, as in color electrophotographic processes and electrophotographic printing processes, the graphite fluoride can behave as a charge control agent common to those developers, and charge control to each of the toners is easy and the chargeability is stabilized.

Further, the graphite fluoride enhances fluidity of developers and prevents toners from fusing to a photosensitive member for a long period of time.

According to the present invention, pigment-containing toners and dye-containing toners are treated with graphite fluoride. Graphite fluoride is finely divided and incorporated into toner or directly added to the developer as independent particles.

In general, the toner may be produced by the following procedure. As a binder, there may be used resins used as a vehicle resin for electrophotographic toners, for example, polymers or copolymers such as polystyrene, chlorinated paraffine, polyvinyl chloride, phenolic resin, epoxy resin, polyester, polyamide, polyacrylic acid resin, polyethylene, polypropylene and the like. The binder resin may be used in combination. In case of printing toners, the following biner may be selected: shellac, gilsonite, copal, rosin, polyester, homopolymers or copolymers of styrene, acrylic compound, xylene, butadiene, coumarone, vinyl chloride, vinylidene chloride, vinyl acetate, ethylene, propylene, diallyl phthalate, butene, vinylpyridine, vinylformal, vinylbutyral, ethyl cellulose and derivatives thereof.

As a colorant, various known dyes or pigments may be added to the above binder, premixed with a vibrating mill, melted and kneaded with a roll-mill, roughly ground with a hammer mill, and finely pulverized with a jet mill to produce a toner. The resulting toner may be mixed with a carrier such as iron powder, glass beads to produce a developer or may be used alone as a developer. The toner may be dispersed and suspended in a highly insulating solvent such as Isopar H (trade name).

As colorant in the present invention, there may be used various dyes and pigments which can be used for conventional electrophotographic toners. For example, there may be mentioned carbon black (C.I. 77266), nigrosine (C.I. 50415), iron oxide black, metal complex salt dyes, chrome yellow (C.I. 14095, C.I. 14025), Hansa yellow (C.I. 11680, C.I. 11710), benzidine yellow (C.I. 21090, C.I. 21095, C.I. 21100), red iron oxide, quinacridone pigment (C.I. Pigment Red 122), rhodamine pigment (C.I. Pigment Red 81), aniline red, Brilliant Carmine 6B (C.I. 15850), prussian blue, ultramarine, phthalocyanine blue (C.I. 74160, C.I. 74180, C.I. 74100) and the like.

When color toners such as yellow, magenta and cyan toners are prepared by using the resin binder, it is preferable to combine the resin binder with the following dyes.

For preparing yellow toners, benzidine yellow organic pigments (3,3'-dichlorobenzidine derivatives) are preferable. Representative benzidine yellow organic pigments are Color Index No. 21090 (for example, commercially available Pigment Yellow 12 and Symuler Fast Yellow GF), Color Index 21095 (for example, commercially available Pigment Yellow 14, Benzidine Yellow G, Benzidine Yellow I.G., Vulcan Fast Yellow G, Benzidine Yellow OT, and Symuler Fast Yellow 5GF, and Color Index 21100 (for example, commercially available Pigment Yellow 13, Benzidine Yellow GR, Permanent Yellow GR, and Symuler Fast Yellow GRF).

For preparing magenta toners, magenta organic pigments of quinacridone series and magenta organic pigments of rhodamine series are preferably used. Representative magenta organic pigments are Pigment Red.

C.I. 122 (for example, commercially available Permanent Pink E and Fastgen Super Magenta RS) and Pigment Red C.I. 81 (for example, commercially available Seikalight Rose 81, Symlex Rhodamine Y, and Irgalite Brillred TCR).

For preparing cyan toners, phthalocyanine blue organic pigments are preferably used. The representative ones are Color Index Nos. 74100, 74250, 74260, 74280, 74255, 74160, 74180 and the like which are commercially available.

In case of producing color toners, the ratio of the dye to the resin binder is important. For yellow toners, usually 2–15 parts by weight, preferably 3–10 parts of a yellow dye is used per 100 parts by weight of the resin binder. For magenta toners, usually 2–10 parts by weight, preferably 2.5–7 parts by weight of a magenta dye is used per 100 parts by weight of the resin binder. For cyan toners, usually 1–10 parts by weight, preferably 2–7 parts by weight is used per 100 parts by weight of the resin binder.

Printing toners to be used are selected in dependence upon cloths to be printed.

As the dye, there may be used, for example, direct cotton dye, sulfur dye, indanthrene dye, naphthol dye, reactive dye, acid dye, acid mordant dye, disperse dye, cation dye and the like. The toner according to the present invention may be prepared by adding about 1–20 parts by weight of a colorant such as dyes and pigments to 100 parts by weight of the resin binder and pulverizing the resulting mixture to produce finely divided powders of about 1–50 microns in size by a conventional method.

The amount of graphite fluoride used in the present invention is about 0.001–10 parts by weight, preferably 0.1–1 part by weight per 100 parts by weight of a toner in a finely divided form of about 0.05–5 microns in particle size. When the amount is less than 0.001 parts by weight, the charge control effect is low while at the amount of more than 10 parts by weight fixability of toner images is lowered. However, if necessary, an amount outside of the above mentioned range may be used for each particular purpose.

According to the present invention, the graphite fluoride may be used in two different ways. One is incorporating the graphite fluoride directly into the toner (an inside adding system). The other is adding the graphite fluoride independently to the developer composition (This may be called an outside adding system in relation to the toner.).

The following Examples are given for illustrating the present invention, but not for limiting the present invention. Parts are by weight unless otherwise specified.

EXAMPLE 1

| | |
|---|---|
| Polystyrene (trade name: PICCOLASTIC, produced by Esso Standard Oil Co.) | 50 parts |
| Chlorinated paraffine (produced by Toyo Soda Mfg. Co., Ltd.) | 50 parts |
| Spilon Black (C.I. 12195) as a metal-containing dye | 2 parts |
| Ultramarine (C.I. Pigment Blue 29) | 2 parts |
| Carbon Black (C.I. 77266) | 9 parts |

The above-mentioned components were mixed and pulverized by a ball mill for 4 hours, and thereafter, the mixture was melted and kneaded by a roll mill and then cooled. Next, the mixture was coarsely pulverized by a speed mill and further finely pulverized by a jet mill. The fine powder thus obtained was classified to prepare a toner from the powder of the grain size distribution ranging from 5μ to 20μ. Further, 10 parts of the toner and 90 parts of carrier iron powder (trade name: EF 250/400, produced by Nihon Teppun K.K.) were mixed to obtain a developer. The triboelectric charge of the toner in the developer was −3.0 μc/g. The triboelectric charge was measured in the following manner:

The developer is placed in a measuring device and weighted together with the device by means of a direct reading balance. This measuring device is connected to a voltmeter (trade name: TR8651, supplied by Takeda Riken K.K.), and then the toner in the developer is separated and removed from the measuring device. At this time, as the needle of the voltmeter deflects, it is stopped at an appropriate value in the scale, and the measuring device is removed from the voltmeter to measure the amount of the remaining developer by a balance. The voltage previously read is divided by the amount of the decreased toner and multiplied by the capacitance of the condenser so that the value of the triboelectric charge (μc/g) is obtained.

The value of the triboelectric charge used in the following examples is that obtained in the above-mentioned manner.

Copying was conducted by a dry type electrophotographic copying machine (trade name: NP-5100, manufactured by Canon K.K.) using the foregoing developer. The obtained image was blurred and unclear.

On the other hand, one part of carbon fluoride (fluorination degree: 100%) of the grain size distribution ranging from 0.5μ to 1μ was added to 100 parts of the foregoing developer and mixed together to prepare another developer. The toner in the obtained developer was −5.6 μc/g in the triboelectric charge. Copying was further conducted by using this developer in the same manner as above so that an extremely clear image was obtained.

EXAMPLE 2

In the same manner as that in Example 1, 70 parts of the polystyrene, 30 parts of silicone resin and 10 parts of Carbon Black (C.I. 77266) were used and carbon fluoride (fluorination degree: 100%) was used in an amount shown in the following table to prepare a toner. 10 parts of the toner and 90 parts of carrier iron powder (trade name: EFV 200/300, produced by Nihon Teppun K.K.) were mixed together to obtain a developer. The triboelectric charge of the toner in the obtained developer is shown in the following table.

| Example No. | Carbon fluoride Amount (part) | Triboelectric charge (−μc/g) |
|---|---|---|
| 2 | 0.01 | 5.5 |
| 3 | 0.05 | 8.6 |
| 4 | 0.1 | 13.2 |
| 5 | 0.5 | 13.4 |
| 6 | 1 | 13.6 |
| 7 | 3 | 12.3 |
| 8 | 5 | 10.5 |
| 9 | 10 | 5.9 |

EXAMPLE 10

The same procedure as that in Example 1 was repeated except that the composition of the toner was changed to that composed of 70 parts of styrene-maleic acid copolymer resin, 30 parts of styrene resin, 4 parts of Phthalocyanine Blue (C.I. 74160) and one part of carbon fluoride (fluorination degree: 100%) to prepare a developer. The toner in the developer was −12.4 μc/g in the triboelectric charge.

EXAMPLE 11

The same procedure as that in Example 1 was repeated except that the composition of the toner was changed to that composed of 70 parts of polyester resin, 30 parts of silicone resin, 5 parts of Brilliant Carmine 6B (C.I. 15850) and one part of carbon fluoride (fluorination degree: 100%) to prepare a developer. The toner in the developer was −13.5 μc/g in the triboelectric charge.

EXAMPLE 12

The same procedure as that in Example 1 was repeated except that the composition of the toner was changed to that composed of 70 parts of polystyrene, 30 parts of silicone resin, 8 parts of Benzidine Yellow G (C.I. 21095) and one part of carbon fluoride (fluorination degree: 100%) to prepare a developer. The toner in the developer was −10.5 μc/g in the triboelectric charge.

EXAMPLE 13

A copying process was conducted which included the steps of exposing a color original through a filter for color separation to a photosensitive material to form an electrostatic latent image thereon, developing and visualizing the latent image by using a sleeve developing apparatus, transferring the visible image to a paper sheet, and cleaning the toner remaining on the photosensitive material, a series of which steps was repeated using three kinds of filters for color separation of red, green and blue at the exposing step, and as the final step, fixing the toner image on the paper sheet by heating. At the developing step, the developer (cyan) of Example 10 was used in case of using a red filter at the exposing step, the developer (magenta) of Example 11 was used in case of using a green filter, and the developer (yellow) of Example 12 was used in case of using a blue filter. Further, the developing step was repeated in the above-mentioned order to obtain a color copy image on the sheet.

EXAMPLE 14

A composition of 20 parts of polystyrene, 80 parts of silicone resin, and 7 parts of Symuler Fast Yellow GF (C.I. 21090) was used to prepare a developer in the same manner as that in Example 1. The toner in the developer was −2.5 μc/g in the triboelectric charge. Copying was conducted in the same manner as in Example 1 so that only unclear image of much fog was obtained.

On the other hand, 0.5 parts of carbon fluoride (fluorination degree: 100%) of a grain size distribution ranging from 0.5μ to 1μ was added to 100 parts of the above-mentioned developer and mixed together to obtain another developer. The toner in the developer was −6.6 μc/g in the triboelectric charge. This developer was used to conduct copying in the same manner as above. As the result, a clear image free from fog was obtained.

EXAMPLE 15

A developer was prepared from the same composition as that used in Example 14 except that Symuler Fast Yellow GF was replaced by Fastgen Super Magenta RS (C.I. 122), in the same manner as that in Example 1. The toner in the developer was −2.1 μc/g in the triboelectric charge. Copying was conducted by using the developer in the same manner as in Example 1 so that only unclear image of much fog was obtained.

Further, 0.5 parts of carbon fluoride (fluorination degree: 100%) of a grain size distribution ranging from 0.5μ to 1μ was added to 100 parts of the above-mentioned developer and mixed together to prepare another developer. The triboelectric charge of the toner in the developer was −5.6 μc/g. This developer was used to conduct the same copying as above so that a clear image free from fog was obtained.

EXAMPLE 16

A developer was prepared from the same composition as that used in Example 14 except that Symuler Fast Yellow GF was replaced by Phthalocyanine Blue (C.I. Pigment Blue 15), in the same manner as in Example 1. The toner in the developer was −3.1 μc/g in the triboelectric charge. This developer was used to conduct copying in the same manner as in Example 1 so that only unclear image of much fog was obtained.

On the other hand, 0.5 parts of carbon fluoride (fluorination degree: 100%) of a grain size distribution ranging from 0.5μ to 1μ was added to 100 parts of the above-mentioned developer and mixed together to prepare another developer. The toner in the developer was −7.3 μc/g in the triboelectric charge. This developer was used to conduct copying in the same manner as above so that a clear image free from fog was obtained.

EXAMPLE 17

| | |
|---|---|
| Polyester resin (trade name: Atlac 382A, produced by Kao Soap Co., Ltd.) | 100 parts |
| Dye (C.I. Dispersed Yellow 5) | 10 parts |
| Carbon fluoride (fluorination degree: 100%) | 1 part |

The mixture of the above mentioned components was heated and kneaded by a roll mill and cooled. Then, it was pulverized by an air-jet pulverizer to obtain a toner having a grain size distribution ranging 5μ to 20μ.

10 parts of the toner and 100 parts of carrier iron powder (trade name: EFV 200/300, produced by Nihon Teppun K.K.) were mixed together to prepare a developer. The triboelectric charge of the toner in the developer was measured to obtain a result as shown in the following table. In the table, the toner for comparison is that obtained in the same manner except that carbon fluoride is not used. This is applicable also to the following examples.

| | Triboelectric charge (μc/g) |
|---|---|
| Toner of the example | −6.5 |
| Toner for comparision | −1.0 |

On a polyester cloth, an image was formed by means of a dry type electrophotographic copying machine (trade name: NP-5000, manufactured by Canon K.K.) using the above-mentioned developer. Steaming treatment was applied to this cloth at 130° C. for 30 minutes and then soaping treatment was applied so that a clear image could be printed. Of course, also when an ordinary paper was used in the transferring instead of a polyester cloth, a good image was obtained.

EXAMPLE 18

The same procedure as that in Example 17 was repeated except that the amount of carbon fluoride was respectively changed to 0.01, 0.05, 0.1, 0.5, 3 and 7 parts by weight to prepare developers.

The developers were used to conduct the same experiment as in Example 17 so that substantially the same results were obtained.

Further, the same procedure as that in Example 17 was repeated except that polystyrene (trade name: PICCOLASTIC D-125, produced by Esso Standard Oil Co.), epoxy resin (trade name: EPICOAT 1007, produced by Shell Chemical Co.) polyamide resin (trade name: VERSAMIDE #904, produced by General Chemical Inc.), polyterpene resin (trade name: POLYSTAR YSP1150, produced by Yasuhara Yushi K.K.), and polystyrene-butadiene copolymer (trade name: 200J, produced by Nippon Geon K.K.) were separately used in place of the polyester resin to prepare developers.

The developers were used to conduct the same experiment as in Example 17 so that substantially the same results were obtained.

EXAMPLE 19

The same procedure as that in Example 17 was repeated except that the dye was, respectively, replaced by C.I. Dispersed Yellow 42, C.I. Dispersed Red 60, C.I. Dispersed Red 207, C.I. Dispersed Red 72, C.I. Dispersed Red 112, C.I. Dispersed Violet 38, C.I. Dispersed Blue 71 and C.I. Dispersed Blue 60 to prepare developers. The same experiment as in Example 17 was conducted so that substantially the same results were obtained.

EXAMPLE 20

The toner (10g) obtained in each of Examples 17, 18 and 19 was dispersed in one liter of Isopar H (trade name, produced by Esso Standard Oil Co.), and 5g. of styrene-butadiene resin (trade name: SORPLEN 1205, Nippon Elastomer K.K.) was further added, and then the mixture was sufficiently dispersed to prepare a liquid developer.

Next, an image was formed on polyester cloth by means of a wet and transferring type electrophotographic copying machine (trade name: NP-L7, produced by Canon K.K.) using the above-mentioned liquid developer. The polyester cloth was then subjected to steaming treatment at 130° C. for 30 minutes and soaping treatment so that a clear image could be printed.

Needless to say, also when an ordinary paper was used instead of polyester cloth to conduct the transferring, a good image was obtained.

EXAMPLE 21

The same procedure as that in Example 17 was repeated except that the dye in the toner was changed to Kayacion Yellow P4G (C.I. Reactive Yellow 18) and polyester cloth was changed to cotton cloth so that substantially the same result was obtained.

In addition, the triboelectric charge of the toner was as shown in the following table.

| | Triboelectric charge (μc/g) |
|---|---|
| Toner of the example | −6.3 |
| Toner for comparison | −0.5 |

EXAMPLE 22

| | |
|---|---|
| Polystyrene | 100 parts |
| Dispersed dye, C.I. Dispersed Blue 60 | 10 parts |

The mixture of the above-mentioned components was heated and kneaded by a roll mill and then cooled. Thereafter, it was pulverized by an air-jet pulverizer to obtain a toner having a grain size distribution ranging from 5μ to 20μ.

This toner (10 parts) and 100 parts of carrier iron powder (trade name: EFV 200/300, produced by Nihon Teppun K.K.) were mixed to prepare a developer. To 100 parts of the developer, carbon fluoride (fluorination degree: 100%) was added in an amount shown in the following table. While the mixture was stirred in a ball mill for a predetermined time, the change in the triboelectric charge of the toner was examined. The results are shown in the following table.

Triboelectric charge of toner (−μc/g)

| Amount of carbon fluoride, (part) | Mixing and stirring time (hr) | | | | | | |
|---|---|---|---|---|---|---|---|
| | Initial | 0.5 | 1 | 2 | 10 | 20 | 40 |
| 0 | 5.2 | 4.5 | 3.4 | 2.3 | — | — | — |
| 0.001 | 6.6 | 6.0 | 5.7 | 3.6 | 3.3 | 3.2 | 3.0 |
| 0.01 | 7.5 | 7.3 | 6.5 | 4.0 | 4.0 | 4.0 | 4.0 |
| 0.1 | 8.5 | 8.0 | 7.1 | 6.3 | 6.0 | 5.8 | 5.3 |
| 1 | 11.3 | 11.2 | 10.2 | 10.0 | 9.4 | 9.0 | 9.0 |
| 3 | 12.4 | 11.5 | 9.5 | 9.2 | 9.0 | 9.0 | 8.9 |
| 5 | 13.0 | 11.4 | 11.2 | 10.3 | 10.0 | 9.8 | 9.0 |
| 10 | 9.2 | 9.0 | 8.5 | 8.0 | 7.5 | 7.2 | 7.2 |

What we claim is:

1. A developer for developing electrostatic latent images comprising toner particles and finely divided graphite fluoride, wherein the amount of graphite fluoride is 0.001–10% by weight based on the toner, and the degree of fluorination of the graphite fluoride is at least 50%.

2. A developer according to claim 1, including a carrier.

3. A developer according to claim 1, in which the finely divided graphite fluoride is contained in the toner particles.

4. A developer according to claim 1, in which the finely divided graphite fluoride is in admixture with the toner particle.

5. A developer according to claim 1, in which the degree of fluorination of the graphite fluoride is 100%.

6. A developer according to claim 1, in which the amount of the graphite fluoride is 0.1–1% by weight based on the toner.

7. A developer according to claim 1, in which the finely divided graphite fluoride is 0.05–5 microns in size.

8. A developer according to claim 1, in which the toner particle is a dye or pigment in a resin.

9. A developer according to claim 2, in which the finely divided graphite fluoride is contained in the toner particle.

10. A developer according to claim 2, in which the finely divided graphite fluoride is in admixture with the toner particle.

11. A developer according to claim 2, in which the amount of the graphite fluoride is 0.1–1% by weight based on the toner.

12. A developer according to claim 2, in which the finely divided graphite fluoride is 0.05–5 microns in size.

13. A toner for developing electrostatic latent images which comprises a colorant selected from dye and pigment and graphite fluoride in a resin, wherein the amount of graphite fluoride is 0.001–10% by weight and the degree of fluorination of the graphite fluoride is at least 50%.

14. A toner according to claim 13, wherein the amount of graphite fluoride is 0.1–1% by weight.

* * * * *